US011229330B1

(12) United States Patent
Gulik

(10) Patent No.: US 11,229,330 B1
(45) Date of Patent: Jan. 25, 2022

(54) DEVICE FOR KEEPING ROLLED PAPER IN CHECK

(71) Applicant: Ryszard Gulik, Palm Bay, FL (US)

(72) Inventor: Ryszard Gulik, Palm Bay, FL (US)

( * ) Notice: Subject to any disclaimer, the term of this patent is extended or adjusted under 35 U.S.C. 154(b) by 4 days.

(21) Appl. No.: 17/249,990

(22) Filed: Mar. 20, 2021

(51) Int. Cl.
*A47K 10/22* (2006.01)

(52) U.S. Cl.
CPC ..... *A47K 10/22* (2013.01)

(58) Field of Classification Search
CPC ..... A47K 10/22; A47K 10/38; A47K 2010/3863; A47K 2010/3872; A47K 2010/3675; B65H 23/08; Y10T 225/38
See application file for complete search history.

(56) References Cited

U.S. PATENT DOCUMENTS 1,432,194 A * 10/1922 Liddell ..... A47K 10/38 242/598.4
1,973,354 A * 9/1934 Nedberg ..... A47K 10/38 225/76
2,650,773 A * 9/1953 Fanning ..... A47K 10/38 242/422.5
2,805,029 A * 9/1957 Fanning ..... A47K 10/38 242/422.4
4,483,491 A * 11/1984 Rainey ..... A47K 10/38 242/129.6
4,804,149 A * 2/1989 Murphy ..... A47K 10/3827 242/422.5
5,558,262 A * 9/1996 Simhaee ..... B26F 3/002 225/106
6,554,222 B1 * 4/2003 Lindow, Sr. ..... A47K 10/38 242/598.5
7,347,395 B2 * 3/2008 Horn ..... B65D 83/0805 242/598.5
10,238,246 B2 * 3/2019 Cittadino ..... A47K 10/38

* cited by examiner

*Primary Examiner* — William A. Rivera

(57) ABSTRACT

The device comprising a base (1) and a paper roll assembly comprising an axle (2), a spindle (3), and a roll of paper (4) controls the rotation of a paper roll of different types from full-size to the last sheet on a paper roll. The spindle (3) of rigid tubing with an inner diameter larger than axle diameter fits in the paper core and between side guides (22) of the axle (2) and moves gravitationally alongside slides below the edge of a base protrusion (12). The center of gravity for the spindle with paper roll works as a pendulum with axle as rotation point, sets the slant angle for slides, amplifies pull force, and works with large rolls where swing extends the lengths of slides. Serrated edge (13*b*) makes perforations in the outside layer of a continuous web of a paper roll.

7 Claims, 4 Drawing Sheets

DEVICE FOR KEEPING ROLLED PAPER IN CHECK

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. The Technical Field of the Invention

The present invention relates to controlling a rotation of paper towels, toilet paper, and continuous web of paper, irrespective of the amount of paper on the roll.

2. Description of Related Art

A paper perforated in a manufacturing process is distributed differently from a continuous web of paper that needs an additional cutting operation. Distributing desired lengths of paper requires a different approach depending on a size of a roll, type of paper, and roll placement.

Separation of length from a roll of perforated paper is done by exerting a force on a paper sheet's lead edge and at the same time blocking the rotation of the roll. Known applications with a fixed distance of spindle from a back wall of fixture fail to provide conditions for working full-size large rolls that cannot rotate in provided space. With a depleting amount of paper, such applications allow the roll to rotate freely and lead to run-outs without a rotation locking mechanism. Separation of length from a roll of a continuous web of paper requires cutting for distribution.

A spindle of Moody (U.S. Pat. No. 5,577,686) controls a centricity of a paper roll and still needs a device that controls the rotation of the spindle for the separation of paper from a roll. Cooke (U.S. Pat. No. 4,454,974) device that controls paper roll rotation uses a counterbalanced lever attachment bar. Morand (U.S. Pat. No. 5,318,210) applies a counterbalanced swinging member inside a fixture to block a toilet paper sheet against a separating edge. Holden (U.S. Pat. No. 6,805,271) places an overhand lever with two parallel cross members, of which one blocks the rotation of a paper towel roll while the other helps to separate the sheet. Device for immobilizing paper working on a roll of any size and type improves the art.

Dispensing devices incorporating electro-mechanical mechanisms in devices disclosed by Byrd (U.S. Pat. No. 8,960,588) in the home environment take space, energy, and financial resources. Providing an inconspicuous, inexpensive device for individual consumers to control dispensing from any type and size of a paper roll improves the art.

Devices that incorporate flanges, like in Irving (GB 587, 290), hooks, brackets, and pins pivotally attached to the mounting base, like in Goodman (U.S. Pat. No. 10,398,263), place paper roll close to a wall that ameliorates run-offs. Providing a device that prevents run-offs and positively restricts rotation of rolled paper irrespectively of the size and type of roll improve the art.

Devices for a continuous web of paper like art, wall, or wrapping paper require a separation mechanism taught by Hrdlicka (U.S. Pat. No. 6,908,007) or Bell (U.S. Pat. No. 6,725,753). The device that alleviates or eliminates the difficulties in distributing a sheet of paper from a full-size large roll of a continuous web of paper to the last sheet on the roll and works as a stationary or mobile device improves the art.

BRIEF SUMMARY OF THE INVENTION

The present invention immobilizes a roll of paper at any point of rotation irrespectively of a type and amount of paper on the roll, warrants separation of a length previously drawn from a roll of perforated paper roll in the first embodiment for a toilet paper and the second embodiment for a paper towel while in the third embodiment for a continuous web of paper also perforates the outside layer of paper on the roll before separation.

The device comprises three components: a base, an axle, and a spindle working in unison. A base is a bracket in u-shape made from a cut and bent flat sheet of stainless steel, but other manufacturing methods and materials are suitable. The back wall of the base has a bottom protrusion that faces inward in the same direction as sidewalls. Slides in the form of elongated cut-outs in the sidewalls have lengths equal to the sum of radiuses of the full-size paper roll and the spindle. Vertical cuts at the front of the cut-out slides allow placing the paper roll assembly in the base. Slides in the sidewalls are slanted diagonally down towards the back wall and terminated below the protrusion edge of the back wall. A vertical distance between the front and rear ends of slides is equal to the distance between the axis of an axle and a spindle placed on the axle. The distance between the axes and the length of the slide determines the slant angle for the slide. The center of gravity of the spindle with the paper roll, continuously placed below and against the back wall protrusion edge of the base, ensures an effective blockade from the full-size to the depleted amount of paper on the roll. The thickness of the sidewalls of the base determines the width of slides, the overall size of the back wall, and the lengths of pivots in the axle, where pivots are longer for wider slides. The length of pivots for cut-out slides in sheet metal sidewalls is presently 6 millimeters.

An axle made presently of a stainless steel rod of 4 to 7 millimeters in diameter, but other materials are suitable, has distinctive three sections separated by two round spindle guides located close to the ends of the axle which work as pivots in slides, and the center section of the axle between spindle guides accommodates spindle rotation. The diameters of the spindle guides are smaller than the paper roll core to fit in. The distance between the outer surfaces of spindle guides matches the distance between the slides in the sidewalls of the base and allows the axle to move glidingly alongside the slides.

A spindle in the disclosed device is a PVC rigid tubing, but other materials are also suitable. The length of the spindle is equal to or longer than the paper roll. The outer diameter of the spindle is close to the size of the paper roll core to fit in. The inner diameter of the spindle rigid tubing assures rotation of a spindle with the paper roll on the axle and is essential for a deformed coreless type roll. The weight of the spindle with paper roll places the center of gravity of relatively light coreless toilet paper roll consistently below the axis of the axle, essential to ensures the device performance from full-size to diminished size of rolls.

The axle and spindle diameters are significantly different, so a distance between the axes of those two parts, under gravity, creates a pendulum that allows the spindle with paper roll to swing on the axle alongside the slide irrespectively of the amount of paper on the roll. An outward pull on the roll of paper at the outermost point on the slide increases the length of the slide by the length of the pendulum and distance of the roll surface from the back wall protrusion edge of the base that allows the device to function with the oversized roll.

The distance from the rotation point of the pendulum, being the axis of the axle, to the edge of the back wall protrusion blocking rotation of the roll on the passive side of the roll, is constant for the actual size of the roll. The distance from the rotation point of the pendulum to the contact of paper with the roll on the draw side that represents the active side varies and depends on the pull angle. The pendulum increases pulling force directly proportional to the inequity between the active and passive distances that allows the device to perforate the continuous web of paper before the separation of the sheet from the roll. More pronounced active distance for a smaller paper layer on the roll provides the more efficient leverage increasing blocking rotation and braking force for the perforated and the continuous web of paper.

The back wall of the base perforations for mounting the device on flat vertical surfaces are standard in the toilet paper or paper towel device embodiments. Disclosed modification of the back wall top edge of the base allows mounting device embodiments for toilet paper or paper towel over an edge of a door inside or outside a cabinet or a rim of a toilet flush-bowl and in the device for large rolls of paper, works as a carrying handle. The extended down sidewalls of the base allow to place or mount the device on a horizontal flat surface using perforations in the extensions of the sidewalls.

The device presented here is for illustration purposes. Variations of materials, dimensions, and shapes are possible within the above description, while conditions determined in appended claims are maintained.

BRIEF DESCRIPTION OF THE DRAWINGS

The drawings of the presently disclosed device for keeping rolled paper in check use arrows to indicate only the main parts and not the features of the parts.

Figure 1:
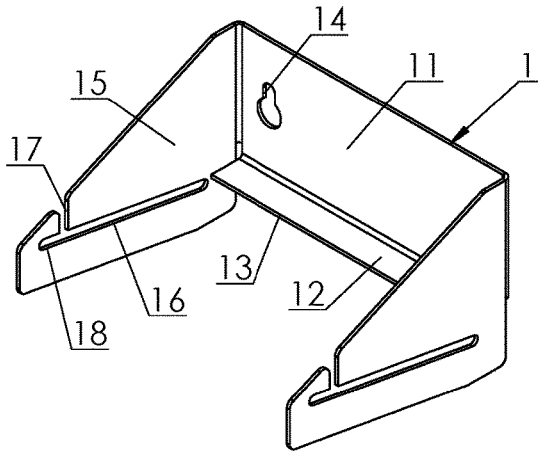
FIG. 1 is an isometric view of a base with cut-out slides.

Drawings do not limit the disclosure of exact details to any or all of the described embodiments, except being essential to explain structural and geometrical functionality for listing claims.

Use of actual terminology to describe an embodiment of the device in the present disclosure as illustrated in FIGS. 1-16 does not exclude any or other technical terminology that may lead to accomplishing a similar function and is limited only by the listed claims.

LIST OF REFERENCE NUMERALS

1—base,
- 11—back wall,
  - 111—edge mounting protrusion (1$^{st}$ embodiment),
  - 111*a*—edge mounting protrusion (2$^{nd}$ embodiment),
  - 111*b*—back wall handle protrusion (3$^{rd}$ embodiment),
  - 112*b*—back wall handle cut-out (3$^{rd}$ embodiment),
- 12—back wall bottom protrusion,
- 13—edge of back wall bottom protrusion,
  - 13*b*—serrated edge of back wall bottom protrusion (3$^{rd}$ embodiment),
- 14—vertical mounting perforation,
  - 14*a*—flat mounting perforation,
- 15—sidewalls with cut-outs,
  - 15*a*—sidewalls with flat slides,
  - 15*b*—thick sidewalls with grooved slides,
- 16—cut-out slide,
  - 16*a*—flat bent slide,
  - 16*b*—grooved slide,
- 17—inserting slot,
  - 17*b*—thick wall inserting slot,
- 18—slide stopper,
  - 18*a*—flat slide stopper,
  - 18*b*—grooved slide stopper,
- 19—sidewall extension,
- 20—surface mounting tab,

2—axle,
- 21—spindle guide,
- 22—side guides,
  - 22*a*—the inner surface of the side guide,
  - 22*b*—the outer surface of the side guide,
- 23—pivot,

3—paper roll spindle,
- 31—outer diameter,

32—inner diameter;
4—toilet paper roll,
4*a*—paper towel roll,
4*b*—roll of a continuous web of paper.
x—length of the pendulum
d—slant angle of the slide
r—spindle radius
R—radius of full paper roll
R1—radius of depleted paper roll

DETAILED DESCRIPTION

Figure 4:
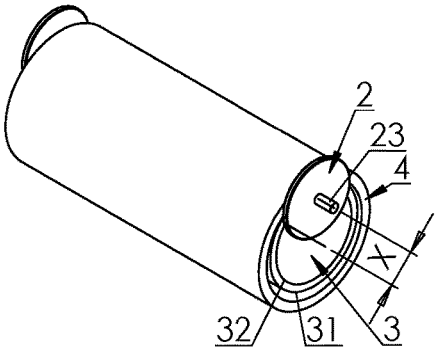
FIG. 4 is an isometric view of a paper roll assembly.

Referring to FIG. 1, an isometric view of base 1 in the first embodiment for use with the roll of toilet paper illustrates parts relevant for all disclosed embodiments of a device. The base in u-shape bracket, formed from a cut and bent flat sheet of stainless steel, wherein the length of back wall 11 with back wall bottom protrusion 12 varies and depends on the widths of the sidewalls 15 and a length of a paper roll for which the embodiment of a device applies. Back wall perforations 14 allow hanging the device on a vertical surface. Cut-outs in peripheral sidewalls 15 have three sections, and each performs a different function: vertical section works as inserting slots 17, slanted down elongated section function as slides 16 for pivots 23 of an axle 2 (FIG. 2), and a section of slide stoppers 18 extend slides 16 beyond the inserting slots 17 and prevent disconnection of a paper roll assembly from the base 1. The lengths of slides 16 are equal to the sum of radiuses of the full-size paper roll and a spindle. Front ends of slides 16 at the inserting slot 17 rise above the rear ends of slides no more than the distance x measured from the axis of the spindle 3 to the axis of axle 2 (FIG. 4). The back ends of the slides fall below the edge of the back wall bottom protrusion 12 and place the axis of the spindle 3 with the paper roll 4 below the back wall bottom protrusion continuously alongside the length of slide 16. The relation of the slide 16 length and value x defines a slant angle of the slide, distinctive for each device embodiment.

Figure 2:
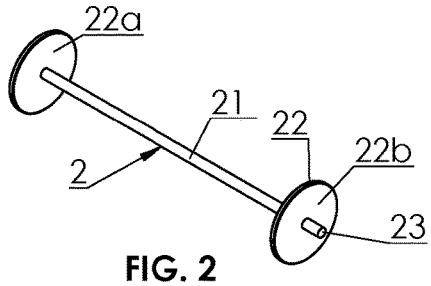
FIG. 2 is an isometric view of an axle.
Figure 3:
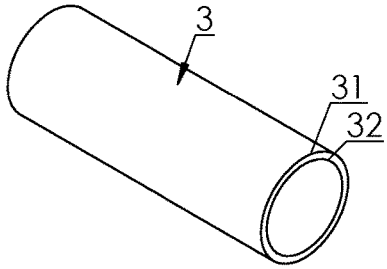
FIG. 3 is an isometric view of a spindle.

Referring to FIG. 2, an isometric view of an axle 2 in the form of a pin for use with each embodiment of the device in which dimensions of axle 2 dictate the dimensions of the base 1. Axle 2 comprises three distinctive sections, a spindle guide 21 at the center and two peripheral pivots 23 separated by side guides 22. The length of the spindle guide 21 is equal to the distance between inner surfaces 22*a* of side guides 22 and matches the length of spindle 3. (FIG. 3). The diameter of side guide 22 allows insertion in a paper roll core. The distance between outer surfaces 22*b* of side guides 22 defines the distance between inner surfaces of sidewalls slides 16 of the base 1 (FIG. 1) and ensures the sliding movement of the axle 2 alongside the slides 16. Lengths of pivots 23 depend on a sidewall thickness, and for the base 1 with cut-out slides in sidewalls 15 are not longer than six (6) millimeters, while for flat slides 16*a* (FIG. 8) or grooved slides 16*b* (FIG. 9), pivots are shorter than the width or depth of the respective sidewall slides.

Referring to FIG. 3, an isometric view of the spindle 3 in the form of rigid tube for use with the device where the outer diameter 31 of the spindle 3 fits in the paper roll core. The inner diameter 32 provides a raceway for a spindle guide 21 of the axle 2. The length of spindle 3 is equal to or longer than the length of the paper roll in each embodiment and fits rotatably between inner surfaces 22*a* of spindle guides 22 (FIG. 2). The largest outside diameter 31 fit in the paper roll core increases the weight and the rigidity of the roll of the soft and light coreless tissue paper, easily deformable. Also, the axis of such fitted spindle better aligns with the axis of the paper roll. The largest justifiable inner diameter 32 increases the distance between the axes of the axle and the spindle in the device assembly.

FIG. 4 illustrates the paper roll assembly for use with the device comprised of axle 2, spindle 3, and a paper roll 4. An x indicates the distance between the axes of axle 2 and spindle 3, preferably with the largest allowable outside 31 and inner 32 diameters that result in the longest value of x. A paper roll 4, here in the depleted state, mounted overhanded on the spindle 3, completes the assembly. The length of spindle guide 21 of an axle 2 (FIG. 2) depends on spindle 3 for each embodiment. Value of x depends on the dimensional relationship between the diameter of axle 2 and inner diameter 32 of the spindle 3 best fitted in the paper core for each embodiment. The value of x defines a size of a pendulum vital in the operation of all device embodiments. The length of pivot 23 is shorter than the width of the slides except for the sheet metal sidewalls, where it is presently 6 millimeters.

Figure 5:
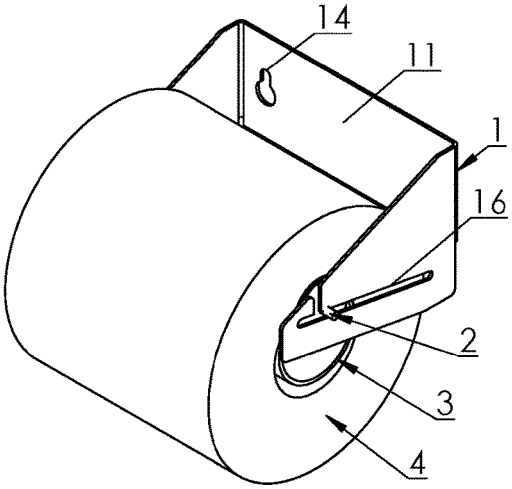
FIG. 5 is an isometric view of a device with a full-size roll of paper.

FIG. 5 depicts the isometric view of a device in the first embodiment for toilet paper with standard perforations 14 in back wall 11. Toilet paper roll assembly fits inside base 1 with cut-out slides 16, where axle 2 supports the spindle 3 with the full-size roll of toilet paper 4.

Figure 6:
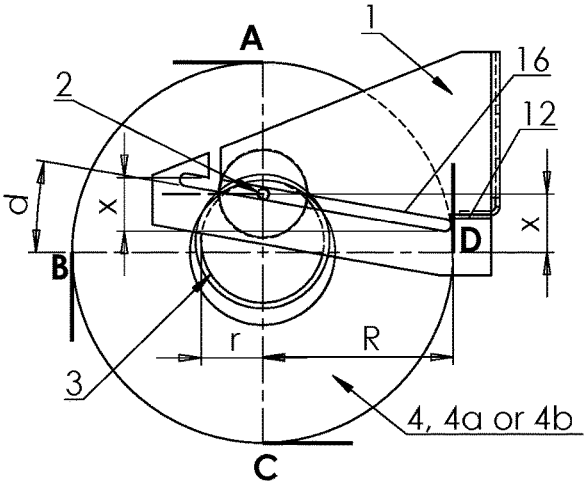
FIG. 6 is a side view of a device with a full-size roll of paper with an indication of pull directions and dimensional relations.

FIG. 6 is a side view of a device with base 1 fitted with paper roll assembly. A full-size paper roll placed overhanded on the spindle 3 in idle position indicates points A, B, C, and D, representing significant directions of pulling paper from the roll in the right angle from each other. The axis of spindle 3 in the paper roll assembly is below the axis of axle 2, as indicated by a distance x. The lengths of slides 16 are equal to the sum of radiuses of the full-size paper roll and a spindle in every embodiment. The value of x and the length of slide 16 defines a diagonal slant angle d. As the inner end of a slide ends below the back wall protrusion 12, the center of gravity of the paper roll on a spindle also ends below the back wall protrusion 12 alongside the entire length of slide 16. The value x depends on the inner diameter of the spindle associated with the type of paper roll in each device embodiment first for toilet paper 4, second for paper towel 4*a*, and third for a web of continuous paper 4*b*.

Figure 7:
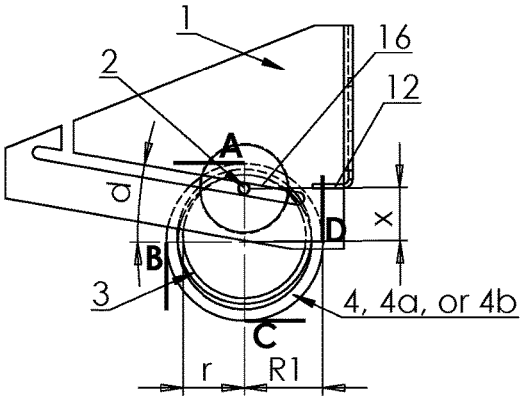
FIG. 7 is a side view of a device with a depleted roll of paper with an indication of pull directions and dimensional relations.

FIG. 7 is a side view of a device with a depleted roll of paper 4 placed overhanded on the spindle 3 in idle position inside base 1 with an indication of points A, B, C, and D, that represent significant directions of pulling paper from the roll in the right angle from each other. At point D, the thickness of depleted paper roll on axle 2 defines a short distance from the axis of axle 2 to the back wall protrusion. At point C the distance from the axis of axle 2 to the contact of the paper sheet with the paper roll is longer by the diameter of the spindle and places paper roll in a favorable position against the back wall protrusion edge 12, preventing upward movement of depleted paper rolls in all embodiments of the device defined by the paper roll types, first for toilet paper 4, second for paper towel 4*a*, and the third for a continuous paper web 4*b*.

Figure 8:
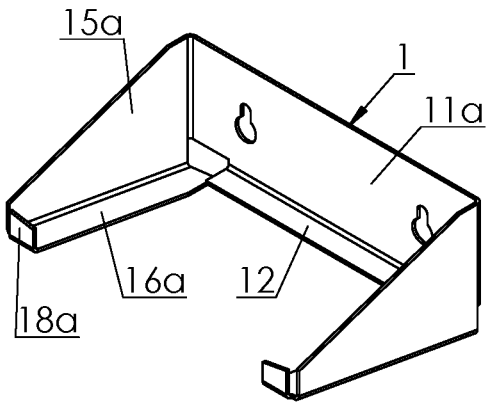
FIG. 8 is an isometric view of a base with bent flat slides.

FIG. 8 is an isometric view of base 1 first embodiment of the toilet paper device with sidewalls 15*a* cut and bend from a sheet of stainless steel, where sidewalls 15*a* bottom edges bent towards each other form rearward-slanted flat slides 16*a*. The inner ends of slides fall below the edge of the back wall protrusion 12. A vertical distance between the inner and outer ends of flat slides equals the distance x measured between the axes of an axle 2 and spindle 3 (FIG. 4) fitted with a paper roll. Slide stoppers 18*a* prevent accidental removal of the paper roll assembly during excessive outward pull on the paper sheet. The back wall 11*a* of device base 1 with flat slides 16*a* is longer by the widths of the flat slides 16*a* while the distance between inner edges of sidewalls flat slides 16*a* of the base 1 matches the distance between outer surfaces 22*b* of side guides 22 of the axle 2 and where pivots 23 (FIG. 2) are shorter than the widths of the flat slides 16*a*. Such a relationship applies to every embodiment of the device having flat slides.

Figure 9:
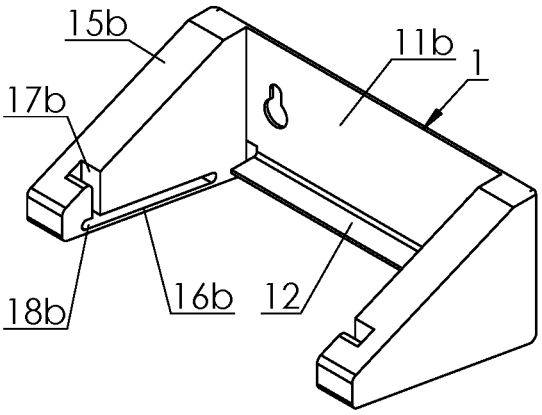
FIG. 9 is an isometric view of a base with grooved slides in thick sidewalls.

FIG. 9 is an isometric view of base 1 first embodiment of the toilet paper device with thick sidewalls 15*b* having rearward-slanted grooved slides 16*b*. The back wall 11*b* of device base 1 with grooved slides 16*b* is longer by the thickness of sidewalls 15*b* while the distance between sidewalls of the base 1 matches the distance between outer surfaces 22*b* of side guides 22 of the axle 2 and where pivots 23 (FIG. 2) are shorter than the depths of the grooved slides 16*b*. The inner ends of slides 16*b* fall below the back wall protrusion edge 12. The vertical distance between the inner and outer ends of the grooved slides 16*b* equals the vertical distance between the axes of the axle and a spindle fitted in paper roll inner diameter (FIG. 4). Front ends of slides 16*b* extend beyond the inserting slots 17*b* and work as stoppers 18*b* to prevent disconnection of the paper roll assembly from base 1 during the excessive pull. The depths of the grooved slides 16*b* allow the pivots of the axle to move slidingly along the slides. Such a relationship applies to every embodiment of the device having grooved slides.

Figure 10:
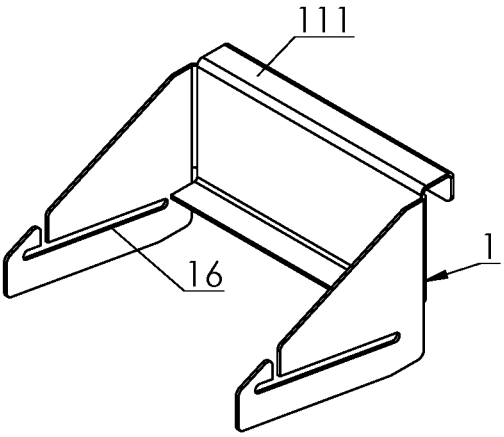
FIG. 10 is an isometric view of a base in the first embodiment for toilet paper hanging over a rim of a toilet flush bowl or outside of a cabinet door edge.

FIG. 10 shows an isometric view of base 1 first embodiment of the toilet paper device with cut-outs 16 in sidewalls. An extension of the top edge of the back wall mounting protrusion 111 allows hanging toilet paper roll on the rim of a toilet flushing bowl or an edge of a door cabinet outside.

Figure 11:
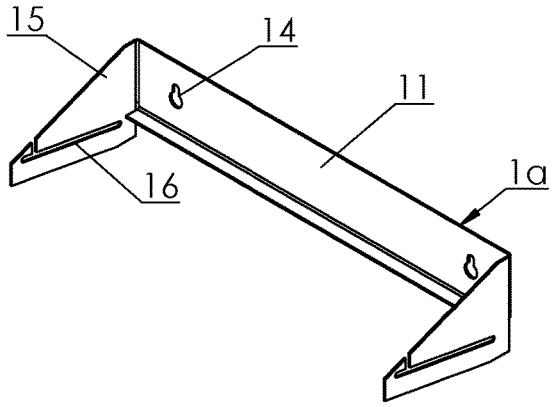
FIG. 11 is an isometric view of a base in the second embodiment for a paper towel with cut-out slides.

FIG. 11 is an isometric view of base 1*a* in a second embodiment of the paper towel device with rearward-slanted cut-out slides 16 in sidewalls 15 with perforations 14 in the back wall 11 for mounting on a vertical surface. Length of the roll, core, and outside diameters of a paper roll determine dimensions of the axle, spindle, the lengths of back wall 11 of the base 1*a*, slide 16, and the slant angle of the slide. The inner end of the slide placed below the back wall protrusion is a standard feature for every embodiment of the device.

Figure 12:
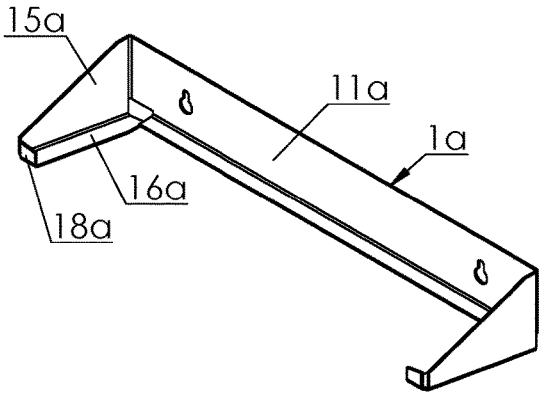
FIG. 12 is an isometric view of a base in the second embodiment for a paper towel with bent flat slides.

FIG. 12 is an isometric view of base 1*a* second embodiment of a device for a paper towel roll for mounting on a vertical surface with perforations 14 with flat slides 16*a* formed at the bottom of sidewalls 15*a*. The dimensional dependencies of base 1 of the first embodiment with flat slides in sidewalls (FIG. 8) apply to base 1*a* in the second embodiment with dimensions related to paper towel roll. The widths of side walls 15*a* extend the lengths of back wall 11*a* by the widths of flat slides 16*a* and define the lengths of pivots 23 of the axle 2 to be shorter than the widths of flat slides 16*a*. Stopper 18*a* of the slide prevents accidental removal of the paper towel roll assembly during the excessive outward pull on a sheet.

Figure 13:
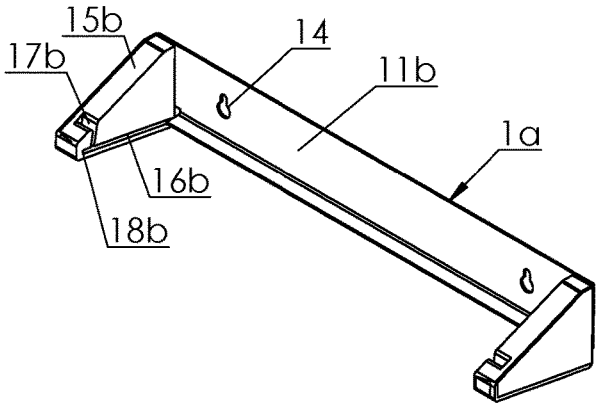
FIG. 13 is an isometric view of a with grooved slides in thick sidewalls.

FIG. 13 is an isometric view of base 1*a* second embodiment of the paper towel device for mounting on a vertical surface with perforations 14 with thick sidewalls 15*b* having rearward-slanted grooved slides 16*b*. The back wall 11*b* of device base 1*a* with grooved slides 16*b* is longer by the thickness of sidewalls 15*b* while the distance between sidewalls of the base 1*a* matches the distance between outer surfaces 22*b* of side guides 22 of the axle 2 and where pivots 23 (FIG. 2) are shorter than the depths of the grooved slides 16*b*. Slant angle, length, and placement of the inner ends of the slides apply like in all embodiments of the device, having grooved slides in the base, where the size of the paper roll determines the dimensions of the paper roll assembly.

Figure 14:
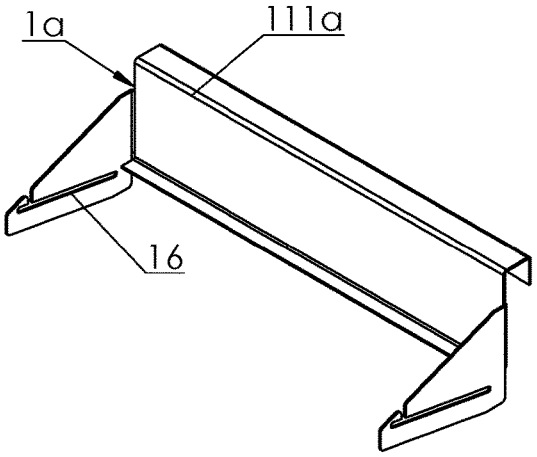
FIG. 14 is an isometric view of a base in the second embodiment for a paper towel for hanging over an edge of a door inside the cabinet.

FIG. 14 is an isometric view of base 1*a* second embodiment of a device for a paper towel with cut-out slides 16 in sidewalls and top extensions 111*a* of the back wall for hanging device inside a cabinet on the edge of a door that is advantageous for use in outdoor kitchen or BBQ cabinet.

Figure 15:
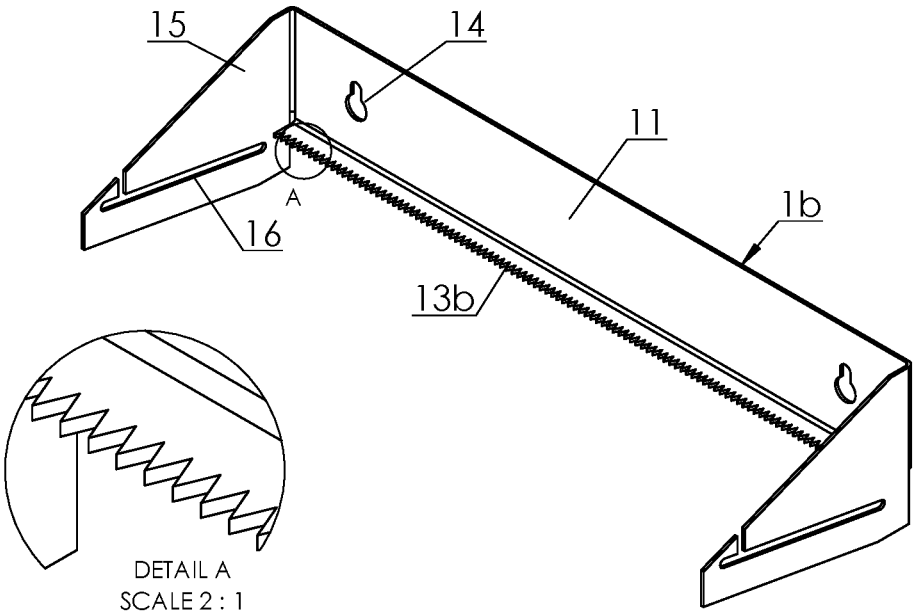
FIG. 15 is an isometric view of a base for the third embodiment for a continuous web of a large paper roll for mounting on a wall showing a detail "A" of a back wall serrated edge protrusion.

FIG. 15 is an isometric view of base 1*b* third embodiment of a device for large rolls of a continuous web of paper like a wall, wrapping, or art for mounting on a vertical surface with perforations 14 having rearward-slanted cut-out slides 16 in sidewalls 15. The length of the roll, the core, and the outer diameters of the full-size paper roll determine the dimensions of the axle 2, spindle 3 of the paper roll assembly (FIG. 4), length, slant angle of cut-out slides 16, and also the length of the back wall 11*b* dimensions of the base 1*b*. Detail A shows a serrated edge of the back wall bottom protrusion 13*b* for perforating an outside layer of a continuous web of paper on the roll.

Figure 16:
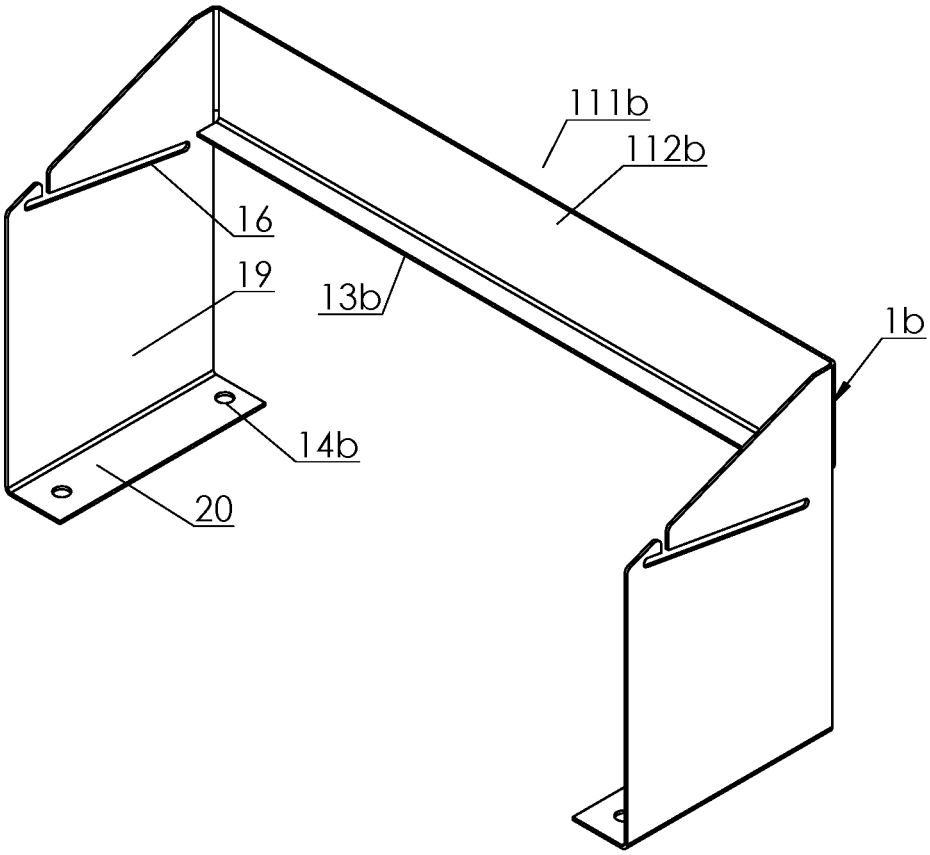
FIG. 16 is an isometric view of a base for the third embodiment for a continuous web of a large paper roll with sidewalls extended down for mounting on a flat horizontal surface having a carrying handle in the back wall.

FIG. 16 is an isometric view of base 1*b* third embodiment of a device for large rolls of a continuous web of paper with rearward-slanted cut-out slides 16 in sidewalls to place on a flat horizontal surface or carry around. The extensions 19 of the sidewalls have surface tabs 20 with perforations 14*b* that allows mounting the device on a flat horizontal surface. The back wall bottom protrusion has a serrated edge 13*b* for perforating the outside layer of paper on the roll. The back wall handle protrusion 111*b* and back wall handle cut-out 112*b* together provide a carry handle for moving the device with a mounted roll of paper.

Operation of the Device

The embodiment of the device disclosed in FIG. 6 best illustrates the operation of the device. A full-size roll of paper 4 placed on the spindle 3 overhanded in idle position indicates points A, B, C, and D, each spaced by the right angle, and marks significant pull paper directions from the roll. The pull directions from A to C are on the active side of the paper roll in which pull on paper sheet causes engagement of the back wall bottom protrusion 12 at point D. The surface of the paper layer from C to A is on a passive side and does not engage the roll with the back wall bottom protrusion 12 during pull except when the roll is in contact in idle position.

Pull on a sheet of paper at any angle in a quadrant between points D to A moves the paper roll 4 by swinging out on pendulum or move alongside the slide 16 away from the edge of the back wall bottom protrusion 12 at point D and allows free rotation of the paper roll. Pull on a sheet of paper between points C and D is ineffective due to the short distance from the wall. The distance measured from the axle axis to the contact line of the paper sheet with the surface of the paper roll on an active side varies and is shortest at point A while longest at point C. The distance from the axle axis to the back wall protrusion edge 12 on a passive side is constant for the amount of paper on the roll. The inequity of the two distances causes the amplification of pulling force in direct proportion to above-disclosed distances between axle 2 and point D on the passive side compared to the distance between axle 2 and the contact line of the paper sheet with the surface of the paper roll at the active pulling side.

The distance x measured between the axes of the spindle fitted in the paper roll and the axle 2 determines the length of the pendulum for the spindle 3 on axle 2 and the slant angle d for slide 16. Pulling on the sheet of paper causes the paper roll to swing in the direction of the pull by up to the distance x, artificially extending the length of the slide and accommodating the device for use with oversized rolls. Force of drawing on a sheet of paper in a quadrant between points A and B moves the paper roll 4 alongside slide 16 against the edge of the back wall bottom protrusion 12, and at point D blocks the paper roll rotation.

The center of gravity of the spindle fitted inside the paper roll always falls below the edge of the back wall protrusion 12, increases engagement of the outside layer of the paper roll with the edge of the back wall bottom protrusion 12 at point D, and prevents upward movement of the paper roll when pulled. Pull on the sheet in the quadrant between points B and C amplify the pulling force more when close to point C, as the inequity of the distances on active and passive sides is more pronounced.

Friction between adjacent layers of paper on the roll depends on a wrap angle value, where a larger angle causes higher friction that defines the strength of pull force before breaking-off the paper sheet. The perforated paper has a definite value of the friction related to the predesigned length of perforated segments and provides less resistance against the pull than an unperforated continuous web of paper on the roll. The force close to breaking the continuous web of the paper amplified by leverage in dimensional inequity disclosed earlier produces the force that causes perforation in the outside layer of paper with serration applied in the protrusion edge 13*b* (FIG. 15).

The depleted roll of paper 4 placed on the spindle 3 overhanded in the idle position as illustrated in FIG. 7 moves closer and below the back wall protrusion edge 12 at point D. The smaller thickness of the paper layer places the axis of axle 2 closer to the back wall bottom protrusion edge at point D and causes even more pronounced amplification of the pull force on the active side increasing the resistance of the roll to upward movement on the passive side. The pull on the active side close to point B that is consistently below the protrusion edge 12 efficiently prevents the run-out and upward movement of the roll until the paper layer depletes completely. Perforating the paper surface on the smaller or depleted roll is also more effortless due to the more pronounced amplification of pull force.

The device described in all embodiments controls the paper roll rotation from full-size to the last sheet of perforated paper, including non-standard large rolls, and can perforate the continuous web of paper like a wall, art, and wrapping paper for subsequent dispensing much the same as perforated paper. The device is described and illustrated hitherto and is determined only by the appended claims. Variations of the materials and techniques utilized in construing the device, when obvious and known by the person having ordinary skills in the art, deems invention valid.

What is claimed is:

1. A device controlling a paper roll rotation, comprising:

(i) a base, having a rectangular back wall with a longer side substantially equal to the length of a paper roll and having a bottom edge protruding in the direction of two sidewalls placed at shorter sides of the back wall, with the sidewalls having rearward and down slanted slides which lengths are equal to a radius of a full-size paper roll plus a radius of a spindle, wherein a vertical distance between a front, and rear ends of the slides are equal to a vertical distance between axes of an axle and a spindle, and wherein the rear ends of said slides end below the edge of back wall bottom protrusion;

(ii) an axle in three sections divided by two side guides with diameters smaller than the inner diameter of paper roll, wherein two outer sections of said axle work as pivots moving alongside the slides in the sidewalls, wherein a length of a spindle defines a length of a central section of the axle between inner surfaces of the guides, wherein outer surfaces of the guides define the distance between the sidewalls of the base and wherein a diameter of the central section of the axle is substantially smaller than the inner diameter of the spindle;

(iii) a spindle, being a rigid tube with a length equal to or longer than the paper roll, fits inside the inner diameter of a paper roll mounted overhanded and between inner surfaces of the guides of the axle, has an inner diameter substantially larger than the diameter of said axle, where such difference creates pendulum between axle and spindle that places the center of gravity of the paper roll below the said edge of the back wall protrusion continuously alongside the length of the slide;

whereby the device ensures distribution of paper from a paper roll, including oversized rolls where the size of pendulum extends the length of the slide at the front end of the slide, places an axis of the paper roll below the protrusion edge of the back wall that prevents upward movement of the paper roll with the pull force at the active side and amplifies an interaction between the outer layer of paper and the protrusion edge of the base on the passive side of the roll, blocking rotation, and assuring separation of the paper sheet with a downward pull independently of the size of the paper roll.

2. The base of claim 1, wherein the size of a paper roll like toilet paper, paper towel, and continuous web of paper dictate the distance between the slides in the sidewalls while maintaining the remaining dimensional relationships intact and determine alternative embodiments of the device.

3. The base of claim 1, wherein serrated back wall bottom protrusion edge makes perforations in the outside surface of the continuous web of paper with force amplified on passive side leveraged by the size of the pendulum and pull angle on the active side of the paper roll.

4. The base of claim 1, wherein bottom edges of sidewalls, bent towards each other, form flat slides with stoppers where lengths of slides are equal to a radius of a full size paper roll plus the radius of the spindle and are slanted rearward and down, wherein the rear ends of said slides end below the edge of back wall bottom protrusion, and the vertical distance between the front and rear ends of the said slides is equal to the distance between the axes of the axle and the spindle.

5. The base of claim 4, wherein thick sidewalls feature rearward and down slanted slides in the form of grooves with stoppers.

6. The base of claim 1, wherein the back wall features a bent extension of the top edge that allows hanging a device for a roll of toilet paper on the outside edge of a cabinet door or a rim of a toilet flush-bowl while for paper towel hanging inside the cabinet on the edge of a door.

7. The base of claim 1, wherein extended downward sidewalls include surface mounting tabs with perforations which work as legs to elevate the device over a flat horizontal surface for a continuous dispensing of web of paper over the flat horizontal surface and for use as a stationary device to attach through the perforations in the surface mounting tabs, and wherein the rectangular back wall is a carry handle including a cutout for use as a mobile device to move by the carry handle.

* * * * *